United States Patent [19]

Belbel et al.

[11] Patent Number: 4,633,209

[45] Date of Patent: Dec. 30, 1986

[54] DC ELECTROMAGNET, IN PARTICULAR FOR AN ELECTRIC SWITCHING APPARATUS

[75] Inventors: Elie Belbel, Epinay sur Seine; Christian Bataille, Chatou; Michel Lauraire, Courbevoie, all of France

[73] Assignee: La Telemecanique Electrique, France

[21] Appl. No.: 756,622

[22] Filed: Jul. 19, 1985

[30] Foreign Application Priority Data

Jul. 24, 1984 [FR] France ..... 84 11704

[51] Int. Cl.[4] ..... H01F 3/00; H01F 7/08

[52] U.S. Cl. ..... 335/261; 335/251; 335/258; 335/279

[58] Field of Search ..... 335/261, 279, 251, 258

[56] References Cited

U.S. PATENT DOCUMENTS

| | | | |
|---|---|---|---|
| 506,282 | 9/1893 | Timmis | 335/261 |
| 750,132 | 1/1904 | Timmis et al. | 335/261 |
| 3,378,732 | 4/1965 | Dietz et al. | 335/251 |
| 4,491,816 | 1/1985 | Blum | 335/245 |

*Primary Examiner*—E. A. Goldberg
*Assistant Examiner*—Lincoln D. Donovan
*Attorney, Agent, or Firm*—William A. Drucker

[57] ABSTRACT

A DC current electromagnet is provided developing a high pulling force with reduced current consumption. This electromagnet has the form of a cylindrical pot and comprises a mobile armature which slides along a yoke piece through a closure air gap —e, S—, whose reluctance is low with respect to the reluctance of the working air gap —E, s— when this latter is open and substantially constant during movement.

6 Claims, 13 Drawing Figures

FIG.5
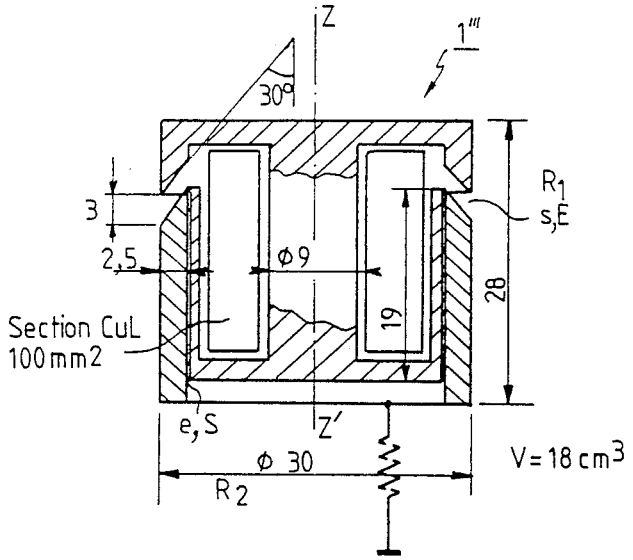
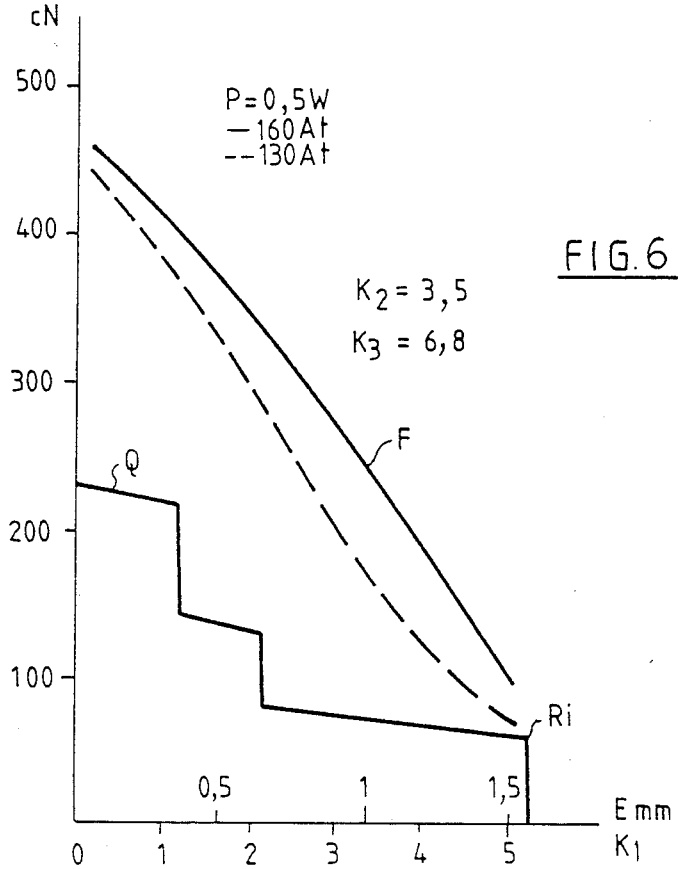
FIG.6

FIG.9
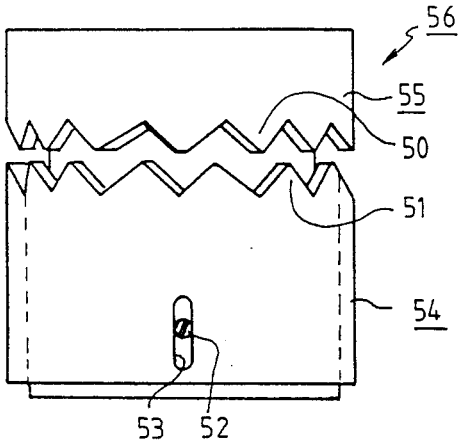
FIG.12
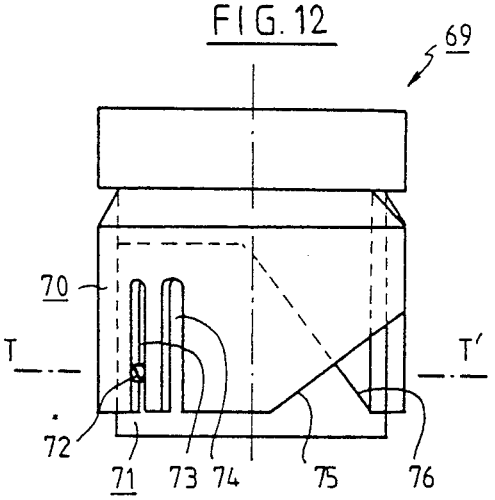
FIG.11
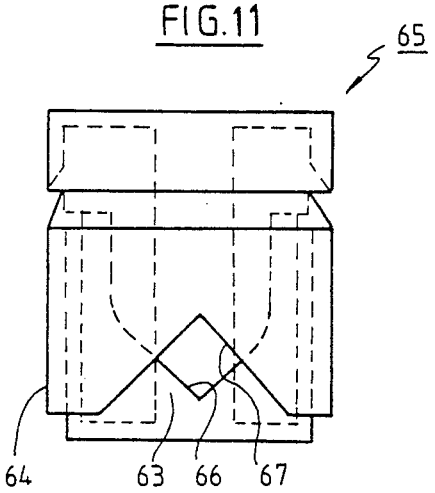
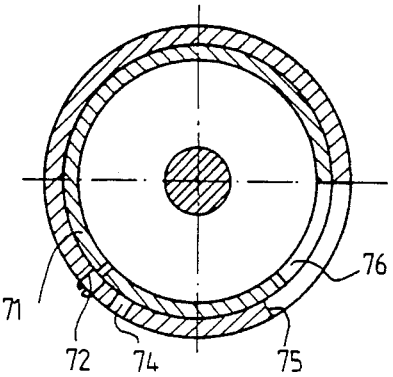
FIG.13

DC ELECTROMAGNET, IN PARTICULAR FOR AN ELECTRIC SWITCHING APPARATUS

BACKGROUND OF THE INVENTION

1. Field of the Invention

The invention relates to a DC electromagnet, in particular for an electric switching apparatus, comprising a magnetizable yoke in the form of a pot having:

- a central core,
- a coil disposed in this pot concentrically to the core, and
- a mobile armature subjected to the action of a return spring and whose peripheral pole surfaces, having a form which increases their values, cooperate with surfaces having the same shape carried by an annular skirt of the pot, through a working air gap which is placed magnetically in series with an air gap closing the flux.

2. Description of the Prior Art

Such electromagnets which are for example known from French patent n. 1 051 651, have advantages and disadvantages with which the user must be satisfied when he contemplates applying them to particular fields; among the advantages must be mentioned the fact that the surfaces of the two air gaps participate at the same time in generating the initial return force; however, because of the ratio of the surfaces of these two air gaps, on the one hand, and because of the presence of two air gaps in series in the magnetic circuit, on the other, it has been discovered that the initial flux is not very high and that, although the induction is relatively high in the core, its value on the peripheral air gap remains low, so that for given ampere turns the initial pull cannot reach interesting values, or, in order to reach these values, it becomes necessary to increase the volume of the coil.

SUMMARY OF THE INVENTION

The invention consequently proposes providing an electromagnet having the above mentioned general construction in which measures will be taken so that low value ampere turns (or in other words a low coil energization power) are capable of communicating to the armature an initial attraction force greater than that which is obtained with the prior techniques, when the travel of the armature and the volume of the electromagnet are practically fixed beforehand.

According to the invention, this aim is reached because the flux closure air gap (e, S) has a large area and a low first reluctance with respect to the second reluctance presented by the working air gap when it is open, and comprises cylindrical surfaces, parallel to the direction of movement of the armature, so that this first reluctance is substantially not effected by this movement.

From published German patent application DE-AS-NR No. 1.097.563 a DC electromagnet is already known for example in which a central flux closure air gap having surfaces parallel to the direction of movement of the armature is placed magnetically in series with two lateral working air gaps, whose surfaces are slanted with respect to said direction; since the magnetic circuit used here has the conventional form of two E shaped elements, it can be seen that not only can the benefits provided by the present invention not be obtained in this case but that in addition attempts to obtain these advantages by giving the elements of the magnetic circuit a form of revolution would be doomed to failure because of the respective proportions which these two air gaps initially have; such an attempt would moreover be constructively contrary to the placing of the guide and transmission means which are there described.

In fact, in one of the embodiments presented in which the closure air gap is placed outside the coil, the reluctance of the closure air gap, which should favor a high flux, cannot bring a substantial improvement to the initial attraction force to the extent that the pole surfaces of the working air gap cannot exceed a certain value without causing a corresponding increase in the volume of the coil, and to the extent that the overlapping surfaces of the closure air gap are small.

In a second embodiment proposed, in which the working air gaps are placed outside the coil and in which the closure air gap is placed thereinside, the value of the initial reluctance is very high because of the fact that the facing mobile surfaces in the closure air gap are extremely reduced; in addition, any increase in their overlap would cause a substantial reduction in the stroke, which would oppose the aims which it is proposed to reach with the mechanism associated with this electromagnet.

Finally, in the two embodiments it can be noted that the freedom which must be given to the two mobile elements of the armature, as well as the space required for the passage of a transmission shaft, reduce the ampere turns applied to this circuit to such an extent that the filling coefficient of the window cannot in this case exceed 30%.

At the present time the problem arises of housing in a small volume, usually occupied by a small sized AC contactor electromagnet, a DC fed electromagnet whose consumption is very small (or in any case, close to that of a signalling relay), so that such electromagnets may be supplied with power in large numbers by the output stages of modern electronic data processing apparatus such for example as programmable controllers.

The difficulties in solving this problem may be evaluated when we consider that such small contactors must be able to simultaneously close, on the one hand three power switches in which the contact pressure forces will sometimes have to permit supplying motors whose power is of the order of 1.5 KW at 220 V, and whose strokes must be sufficient to ensure if need be good insulation for supply voltages of the order of 600 V and, on the other hand, up to three auxiliary signalling switches; it is moreover known that it is difficult to manufacture two electromagnets of the same volume, having equal performances, one of which is supplied with AC current and the other with DC current, considering the considerable physical differences which distinguish their respective operation.

These data may be specified, for example, by the established fact that, when the volume imposed is less than 20 $cm^3$, when insulation such as mentioned above requires opening strokes of 3 to 4 mm, when a pressure of the order of 250 g on closed contacts is required because of the presence of the above mentioned switches, and when a power of 0.5 W for supplying the coil is at present an objective aimed at by constructors, only about 130 ampere turns are available for the electromagnet to develop an attraction force of the order of 100 cN (even when a voltage drop or a high temperature rise occur) so that the need to maintain the assembly of the mobile masses in their rest position is securely fulfilled.

Moreover, the modern tendencies to reducing technical assembly costs and to increasing reliability mean that it is desirable to transmit directly to the contacts, i.e. without movement step-up means, the movements effected by the armature of the electromagnet.

In contactors of this type, in which the number of operations may reach very high figures, it is necessary to reduce the damage and wear which repeated impacts of the armature on the fixed yoke might cause.

In an advantageous embodiment of the invention, in which the reduction of the intensity of these shocks has been taken into account, and which is accompanied with an additional reduction in volume of the coil tending in the same direction as the above defined objectives, the reduction of the terminal attraction force is determined by a choice of the diameter of the core which causes therein local appearance of saturation phenomena only having a preponderant temperature when the reluctance of the working air gap decreases.

In a particular embodiment of these latter measures which aims at giving to the attraction curve a substantially linear increasing trend, these saturation phenomena cause the induction in the coil to develop substantially in a ratio of one to two.

BRIEF DESCRIPTION OF THE DRAWINGS

The invention will be better understood from reading the following description:

In the accompanying drawings:

FIG. 5 shows the dimension which the electromagnet of the invention may have so as to comply with numerical data furthermore defined;

FIG. 6 shows a diagram of the evolution of the forces of attraction and of the resistant forces met with by an electromagnet in accordance with the invention, when it is applied to a small contactor;

FIG. 9 shows an electromagnet in accordance with the invention, in which the increase in the area of the working air gap has been obtained in ways different from the preceding ones;

FIG. 11 shows, in an external elevational view, an electromagnet in which the reluctance of the closure air gap develops during the travel of the armature; and FIGS. 12 and 13 illustrate, in an external elevational view and, respectively, in a top view in section through plane TT', an electromagnet having the same properties as the preceding one, but in which the evolution of the reluctance may be chosen from one of two possible evolutions.

DESCRIPTION OF THE PREFERRED EMBODIMENTS

Figure 1:
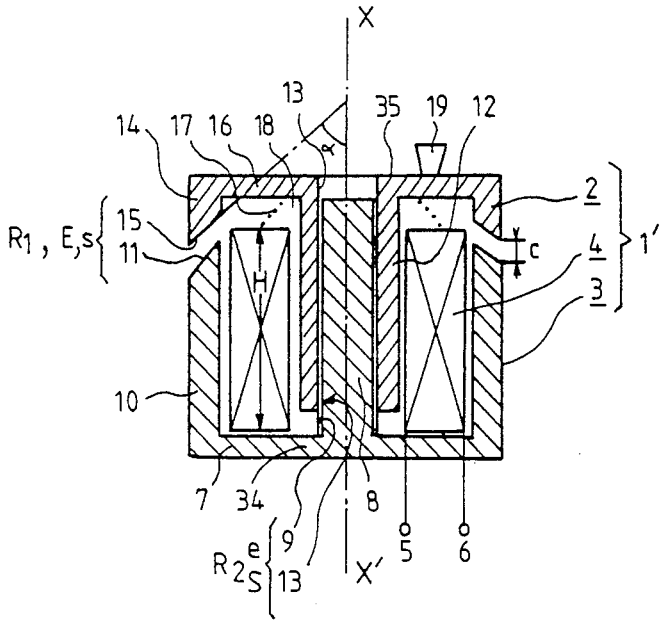
FIGS. 1, 2 and 3 show a first embodiment of the invention, in which the closure air gap is disposed inside the coil whereas the working air gap is situated at the periphery of the pot.

An electromagnet 1' in accordance with the invention and shown in FIG. 1 has two magnetizable pieces of revolution 2, 3 moveable with respect to each other along a common axis of revolution XX', and engaged one in the other. These pieces once engaged have the appearance of a pot whose inner volume 18 is occupied by a coil 4 having current lead-ins 5, 6 which pass for example through the piece 3 considered here as being fixed, whereas the reverse would also be possible.

Piece 3 comprises a substantially flat bottom 7 in the center of which projects a cylindrical core 8 having on its outer surface a thin layer 9 of an amagnetic material with good friction properties. An annular skirt 10 outwardly extends the bottom parallel to the core and comprises at its free end a conical surface 11 of revolution forming an angle $\alpha$ with the axis.

The second piece 2, which is therefore here assumed moveable, has a shape comparable to that of piece 3, but comprises in the center of its bottom 16 a tubular extension 12 whose bore 13 has core 8 passing therethrough and slides thereover with an easy fit, whereas its short skirt 14 has a conical surface 15 of angle $\alpha$ which is parallel to the preceding one, opposite which it is situated.

Because of the properties and the very function of the electromagnet, a return spring 17, which, by way of example, has been disposed inside volume 18 between pieces 2 and 3, but which could be placed outside, imparts to piece 3 a force returning it to a rest position in which it comes up against a stop 19 and in which a distance "c" equal to the relative travel of pieces 2 and 3 separates the conical surfaces parallel to axis XX'.

The mobile piece 2, which will henceforth be called armature, may be mechanically coupled to any piece or device for communicating thereto a movement of an amplitude equal to "c" which, in order to occur, requires the ampere turns flowing in the coil to be sufficient to overcome, first of all an initial resistant force, by means of an initial pulling force developed by the attraction of the armature, and are then used efficiently for overcoming other resistant forces which appear during the movement, for example for operating the compression of pressure springs, if the armature is associated with mobile switch contacts (not shown).

It can be seen that the ampere turns developed by a coil are essentially used for magnetizing, on the one hand, the working air gap E which separates the conical pole surfaces and, on the other hand, the inevitable closure air gap —e— through which the magnetic flux must pass.

The initial induction $B_i$ in air gap E, as well as the dimensions of pull surfaces 15 and 11, must themselves be sufficient for the initial pulling force $f_i$ to be greater than the initial resistant forces $R_i$.

The dimensions of an electromagnet capable of developing such a pulling force, when a travel "c" must be effected while overcoming initial resistant forces whose subsequent variation is known in advance, may be obtained without difficulty by known means and known calculation, when the power and the volume which the electromagnet can have are not subjected to any particular restriction.

The same cannot be said when, for example, it is desired to place, in a contactor case using an AC electromagnet, an electromagnet supplied by a DC current, for the volume of this latter is generally greater by about 50%, or to limit the power of an electromagnet, for example to a power of a half Watt, while requiring it to develop initial attraction forces of the order of 100 cN, while then travelling over a distance of the order of 3 to 4 mm.

It is further known that if, contrary to the behavior of electromagnets supplied with AC current, the armature of an electromagnet fed with DC current only undergoes a low attraction force when operated, this latter then follows a very rapid increasing evolution whose excess with respect to the resistant forces becomes not only useless but even harmful because of the final speed which the armature then reaches when no auxiliary means or phenomenon hinders the evolution.

Figure 2:
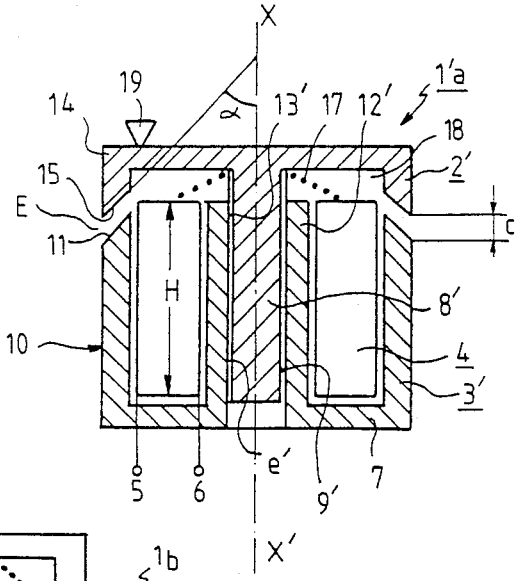

Another electromagnet 1'a, shown in FIG. 2, in which the same references refer to elements having the same functions, is directly derived from the preceding one by reversing the position of core 8' and the tubular extension 12' which are now connected to armature 2' and to the yoke pot 3'. In the two embodiments shown in FIGS. 1 and 2, the axial length along which the air gap —e—, respectively —e'— extends will be as large as possible for reasons explained further on; in all cases, this length will always be close to the height —H— of coil 4.

Figure 3:
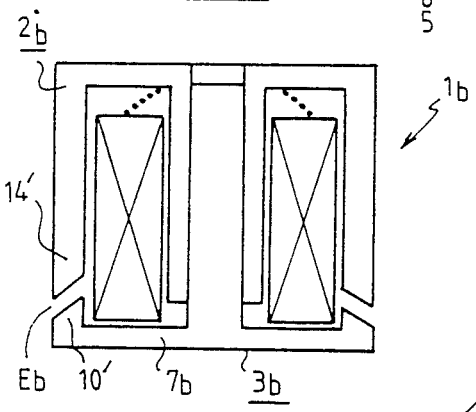

The electromagnet 1b shown in FIG. 3 shows how the position of the working air gap $E_b$ may be modified in one or other of the embodiments illustrated in FIG. 1 or 2, by bringing this air gap close to the bottom 7b of the fixed yoke 3b so as to reduce the leak fluxes which might not cooperate in the attraction of the armature; skirt 14' of the mobile armature 2b is here longer than in the preceding case while skirt 10' is on the other hand shorter.

Figure 4:
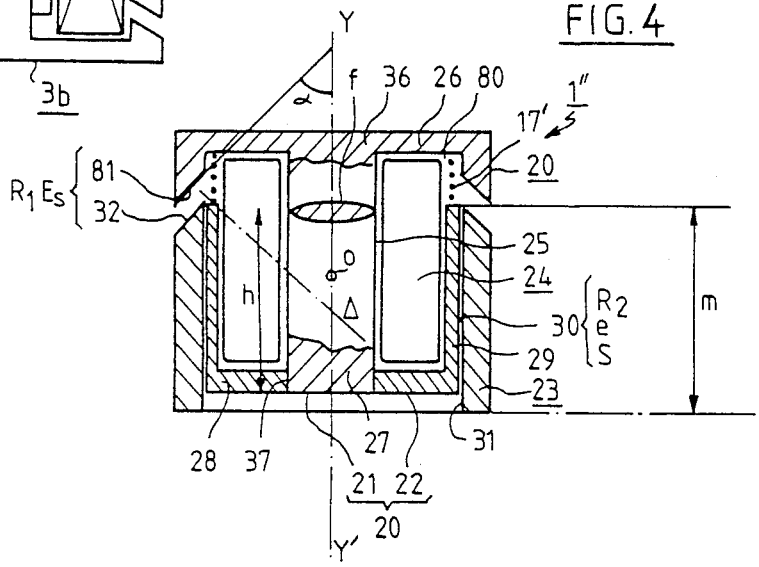
FIG. 4 illustrates a second embodiment of the invention, in which the working and closure air gaps are placed at the periphery of the pot.

Another electromagnet 1'' in accordance with the invention, and shown in FIG. 4 comprises a fixed yoke 20 which is formed by the assembly of two magnetizable pieces of revolution 21 and 22, a mobile magnetizable armature 23, a coil 24 and a spring 17'.

Once assembled, yoke 20 retains, in an inner volume 80, the coil which has been previously fitted about a solid core 25 of piece 21 concentric with and secured to a bottom 26 having at its periphery a slanting surface 81 forming an angle $\alpha$ with axis YY'.

The free end 27 of the core is here anchored in the flat bottom 28 of piece 22, which is extended by an annular skirt 29 whose surface is preferably coated with a fine layer of amagnetic antifriction material 30 and which extends parallel to core 25.

The mobile armature 23 has the form of a ring whose cylindrical inner surface 31 slides with an appropriate clearance over layer 30 and one end of which placed opposite surface 81 has a parallel tapered surface 32; the length "m" of this armature is preferably greater than the height "h" of skirt 29, for allowing it to slide without the contact surface being reduced and so the reluctance increased; it will be seen further on that certain modifications may however be made to the value thereof so as to comply with particular objectives. It can be seen that, with this arrangement, the whole of the internal volume 80 of yoke 20 is occupied by the coil 24.

In the two embodiments of the invention, the ampere turns —ni— developped by the coil when it has the current flowing therethrough, cause a flux $\phi$ to develop which will flow through the magnetizable pieces, while passing on the one hand, through a working air gap placed between the tapered surfaces 81, 32, respectively 11, 15 and whose dimension is —E— and, on the other, through a closure air gap which is materialized by the thickness —e— of the layer of antifriction material.

The air gap E whose area is —s— and the air gap —e— whose area is —S—, define reluctances $R_1$ and $R_2$ which give to the flux a value $\phi$ causing inductions $B_1$ and $B_2$ to appear.

In the electromagnets of the invention, it is provided for the reluctance $R_2$ to be as small as possible will respect to reluctance $R_1$ when the armature is in the open position and so that the product of the square of the initial induction $B_1$ multiplied by the surface —s— (or initial force of attraction $-F_i$) is as high as possible when the armatures are at rest, so as to easily overcome the initial resistant forces $R_i$.

It will be noted that this initial induction $B_1$ must be chosen so that the current attraction force is able to develop while remaining for example greater than the progressive or stepped resistant forces which are successively or simultaneously met with when the armature actuates mobile contacts of a contactor. In fact, if the initial induction were already high, the appearance of saturation in the magnetic circuit would cause a slow growth of the attraction forces when the armature moves.

When the initial induction $B_1$ is suitably chosen, saturation only appears (if it appears) on the surfaces —s— when the armature is very close to the yoke, and the effects of saturation develop beforehand either in coil 8 of section —f—, respectively 25, or in the regions 34, 35, respectively 36, 37, so that the growth of the attraction forces is just greater than the growth of the resistant forces.

The advantage of causing saturation to appear at these levels by giving to them an appropriate section, follows from the fact that any reduction of the section of the core will also react favorably on the volume of the coil, so on the power which will be required for causing the ampere turns to appear. Such a reduction, which is also reflected on the total volume of the electromagnet, is also favorable to the removal of Joule losses since, for a constant current density, the external surface of the electromagnet decreases proportionally less than the internal volume. The dimensions and parameters of an electromagnet 1''' in accordance with the invention, which are given in FIG. 5, and the evolution of the attraction force which is given in the graph of FIG. 6 show, that, on the one hand, the volume of such an electromagnet (fed with DC current) may rival that of an electromagnet fed with AC current and, that on the other hand, the power required for energizing same, which is of the order of 0.5 W, allows a large number of small contactors which use these electromagnets to be supplied directly with power by the output stages of an electronic control unit such as a programmable sequencer.

Figure 7:
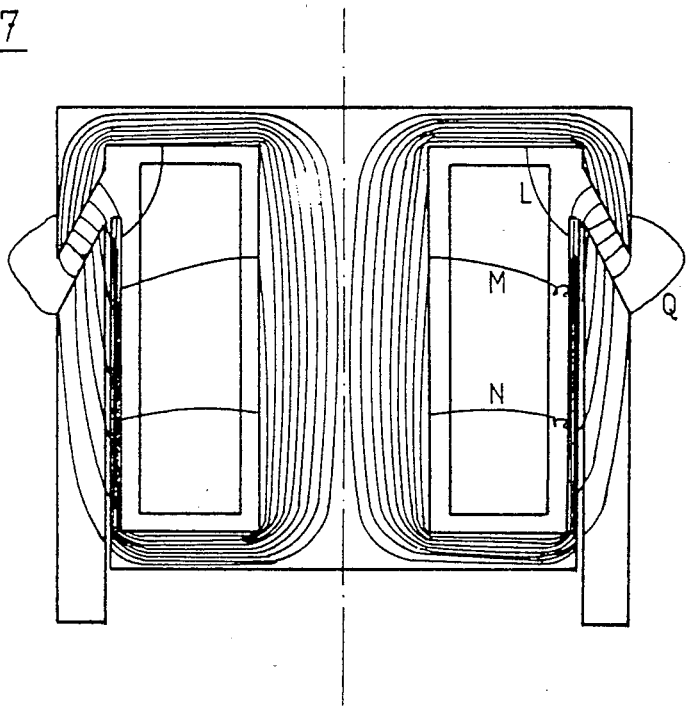
FIG. 7 illustrates a distribution of the flux developed in the circuit for a certain position in the armature.

It will be noted, on inspecting FIG. 7 which shows the distribution of the flux in open circuit, that the leak fluxes likely to appear in regions L, M, N, Q are very small; this good result is due to the fact that the sections of the magnetic masses other than the core are chosen so as not to be saturated.

It will also be noted that a large freedom is given to the designer and/or to the user for choosing the value of the area —s— the best adapted to his needs, because of the more or less pronounced slope $\alpha$ of the tapering surfaces.

In practice, the air gap E= . . . is determined by the value of the travel —C— required for obtaining good isolation and good compression of the mobile contacts associated with the armature and the slope $\alpha$ results therefrom, whereas the value of the air gap —e— cannot drop below a reasonable threshold, which is determined by the means and materials used in economic large scale production; 0.1 mm<e<0.5 mm may for example be chosen.

Figure 8:
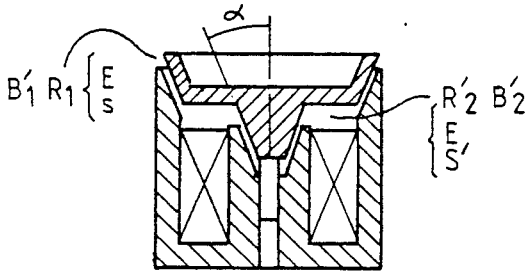
FIG. 8 shows, for comparison purposes, a pot shaped electromagnet of the prior art.

A rapid and simplified calculation whose details are given below shows that the performances of a pot electromagnet of conventional shape, which is illustrated in FIG. 8, are for equal dimensions appreciably less than those of an electromagnet of the invention; the flexibility of control of the induction $B_3$ of the core which is required in the invention is obtained without detriment either for the attraction force or for the volume of the coil, which advantage cannot be found in the electromagnet shown in FIG. 8 because the voluminous internal region of the core which is used for developing a considerable part of the attraction force is also that in which the saturation phenomena will be first of all appear.

Let —ni— be the available ampere turns and —R— the reluctance of the magnetic circuit considered as represented solely by the air gaps, so not taking the saturation into account; the constant coefficients are represented by the letter G.

$$ni = R\phi \quad \phi = \frac{ni}{R}$$

$$\text{and } R = R_1 + R_2 \text{ with } R_1 = \frac{E}{s} \; R_2 = \frac{e}{S}$$

$$\text{supposing } E = K_1 e \text{ and } S = K_2 s, \; R \text{ becomes } \frac{e}{s} \cdot \frac{K_1 K_2 + 1}{k_2}$$

therefore:

$$\phi = \frac{ni}{e} \cdot s \cdot \frac{K_2}{1 + K_1 K_2} \cdot G$$

$$B_1 = \frac{\phi}{s} = \frac{ni}{e} \cdot \frac{K_2}{1 + K_1 K_2} \cdot G$$

$$B_2 = \frac{\phi}{S} = \frac{\phi}{K_2 s} = \frac{ni}{e} \cdot \frac{1}{1 + K_1 K_2} \cdot G$$

$$B_3 = \frac{\phi}{f} = \frac{ni}{e} \cdot \frac{K_2}{1 + K_1 K_2} \cdot \frac{s}{f} \cdot G$$

The initial attraction force Fi is given by:

$$Fi = B_1^2 s = G^2 \cdot \left(\frac{ni}{e}\right)^2 \cdot \left(\frac{K_2}{1 + K_1 K_2}\right)^2 \cdot s$$

In the invention, in which the stroke of the armature is 3 mm and in which the angles $\alpha$ form 30°, a closure air gap —e— has been chosen equal to 0.3 mm and a working air gap —E— equal to 1.5 mm results from the geometrical choices; consequently, $K_1=5$.

For an outer diameter of 30 mm and a height —h— equal to 19 mm, we have s=4.3 cm $^2$, S=15 cm$^2$; consequently $K_2=3.5$ therefore $$Fi = (ni)^2 \cdot \left(\frac{3.5}{1 + 17.5}\right)^2 \cdot 4.3 \cdot \frac{1}{(0.03)^2} \cdot G^2$$

-continued $$Fi = (ni)^2 \cdot \left(\frac{3.5}{18.5}\right)^2 \cdot \frac{4.3}{(0.03)^2} G^2 = G^2 \cdot (ni)^2 \cdot 170$$

If we give to an known electromagnet shown in FIG. 6 the same outer dimensions, the same stroke, the same working air gap dimensions (E,s), and if a closure air gap E is taken into account disposed on a core of the same section —f— in which the angle $\alpha=30°$, we have $$R'_1 = \frac{E}{s} = R_1 \; R'_2 = \frac{E}{S'} K'_1 = 1$$

$$\text{with } S' = 0.64 \text{ cm}_2 \times 2 = 1.28 \text{ cm}_2$$

$$\text{and } s = 4.3 \text{ cm}_2$$

$$\text{we have } K'_2 = \frac{S'}{s} = \frac{1.28}{4.3} = 0.3$$

The application of the same formulae for identical ni and taking into account the fact that an induction $B'_1$ is applied to —s— and an induction $B'_2$ is applied to S' through two air gaps —E— of values equal to 1.5 mm, gives a total initial force:

$$F'i = \left(\frac{ni}{E}\right)^2 \cdot s \left[\left(\frac{K_2'}{1 + K_1' K_2'}\right)^2 + \frac{K_2'}{(1 + K_1' K_2')^2}\right] \cdot G^2$$

$$= (ni^2) \frac{4.3}{(0.15)^2} \left[\left(\frac{0.3}{1 + 0.3}\right)^2 + \frac{0.3}{(1 + 0.3)^2}\right] \cdot G^2$$

$$= (ni)^2 \cdot \frac{4.3}{(0.15)^2} [0.053 + 0.177] \cdot G^2$$

$$= G^2 \cdot (ni)^2 \cdot 44$$

Between Fi and F'i there exists therefore a multiplication ratio equal to (170/44)=3.9.

The comparison between an electromagnet 1' shown in FIG. 1 or 2, for example with S=5.6 cm$^2$ when H=1.9 cm and so $K_2=1.3$ and a conventional electromagnet leads to a still very favorable proportion of (143/44)=3.25.

The reserve of amplification of the initial attraction force supplied by the electromagnet of the invention allows multiple applications to be contemplated in which not only this force but also its evolution may be readily adapted to the needs, by modifying not only the ratios $K_1$ and $K_2$ but also, if required, the ratio $K_3$ which relates the working pole surface —s— and the section —f— of the core according to the equality $s=K_3 f$.

This ratio $K_3$ whose increase for a given area —s— and a coefficient $K_2$ causes saturation of the core to appear earlier and so for example allows the terminal induction $B_1 t$, and so the terminal attraction force to be defined; in the embodiment shown in FIG. 5, $K_3=6.8$.

An increase in $K_2$ which reduces the reluctance $R_2$ increases the intial attraction force, as well as the growth rate; its adjustment also allows the attraction force to be fixed at mid travel as required, just before the effects of saturation may make themselves appreciably felt.

In the embodiment shown in FIG. 5, in which the objective is to cause the electromagnet of a small contactor to overcome the resistant forces —O—, calculation and plotting show that (with $K_2$ equal to 3.5) the force of attraction F is close to half its maximum value after an initial stroke going from 30 to 40% of the total stroke and that the initial force is close to 100 cN.

The use of very slanting working pole surfaces, which might possibly create some difficulties of cooperation on closure, is only necessary if it is desired to reach high initial forces, without the external dimensions and the mass of the armature becoming excessive.

The fact of replacing the conical surfaces of the electromagnet shown in FIG. 5 by straight surfaces separated by the value of the stroke, would modify at one and the same time the ratios: $S+K_2 s$ by giving $K_2=7$ and $E=K_1e$ by giving $K_1=10$; these values can no longer give to the initial force of attraction an advantageous amplification with respect to the prior art; the important role played by the slant of the surfaces of the working air gap can then be seen.

In the simplified calculations used above for effecting comparisons, the friction forces have not been taken into account; it is clear that if these forces are expressed by the effects of a lateral attraction force which friction against the surface of the skirt 29 of the pot may communicate to the annular armature 23, an optimization calculation may be carried out so as to find the most appropriate values of $K_1$,$K_2$ and $K_3$.

The expression of the net useful force Fu then comprises a coefficient of the form $(1-r/K_2)$ which shows, if need be, that this force is greater when the friction coefficient r is small and when $K_2$ is high.

Simulations have allowed an evolution of the induction $B_3$ in the core to be chosen which is advantageously between 0.7 Tesla and 1.6 Tesla (i.e. a ratio close to 2) when the armature closes, this evolution being well adapted to the application to contactors.

In a variant 56 of the electromagnet, the invention may have other forms of embodiment which still place it within the desire to obtain an initial high force of attraction; instead of using slanting surfaces governed by cones, the pole surfaces of the working air gap could each have a series of teeth 50, respectively 51, with slanting sides, cooperating by penetration of projections of one in the gaps of the other; angular orientation means 52, 53, for example comprising an axial groove and a transverse pin, may then be necessary for preventing rotation of armature 54 with respect to yoke 55 at the time of energization of the coil, see FIG. 9.

Figure 10:
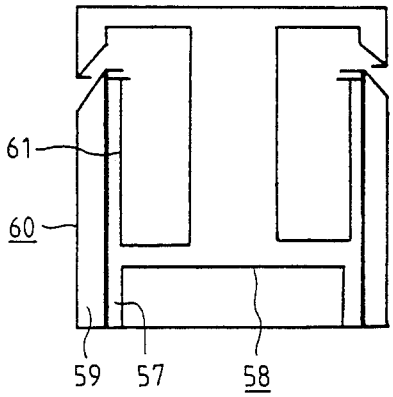
FIG. 10 shows one example of the measures which may be taken for reducing the reluctance of the closure air gap.

An increase in area S which the closure air gap must have (and so of $K_2$) may be obtained for example by means of an extension 59 of armature 60 cooperating with an extension 57 of skirt 61 belonging to yoke 58, see FIG. 10.

While still keeping a high value of the area of the closure air gap S, it may be desirable, for applications in which a slow evolution of the curve of attraction must meet particular requirements, that its value decreases during the travel of the armature; such a result may be obtained by forming in skirt 63 of the electromagnet shown in FIG. 11 and in its annular armature 64, cutouts 66, respectively 67, preferably symmetrical, which modify the values of the facing areas S when this armature moves. The gradual angular distribution of the cut-outs 75, 76 would allow, as required, one of several possible attraction curves to be chosen by giving to the armature 70 of the electromagnet 69, before assembly, a particular angular orientation with respect to the yoke pot 71, which orientation would be provided by guide means such as pin 72 and groove 73, 74 shown in FIGS. 12 and 13.

Finally, it may be noted that the choice of the orientation of the conicity of the surfaces of the working air gap, shown in FIGS. 1, 2 and 3, was made so that the effects of a slight radial clearance present on the closure air gap does not produce an imbalance of the values which two diametrically opposite working air gap portions may assume; such an imbalance, which would occur in the opposite case, could cause jamming, see FIG. 3.

The orientation chosen may be defined as that which causes a normal half straight line erected on a concave conical surface such as 15, respectively 81 (see FIG. 4) to pass in the vicinity of a central point O placed on the axis of symmetry XX', respectively YY'.

The notion of cylindrical pot, which has been used in the preceding examples, must not be limited to that of a cylinder of revolution which forms however the most advantageous embodiment thereof.

The use of right cylinders may also be considered whose external surface would be defined by the path of a straight line generatrix bearing on a directrix curve of figure different from a circle.

With the use of particular manufacturing means and processes, it is possible to form electromagnet pots of a substantially prismatic shape or, in other words, pots of square or rectangular section with rounded edges, so as to increase the surfaces which limit the pulling air gap; the closure air gap may then be formed by means of an insulating layer in the form of a film which is bonded to the skirt of this pot and to a sliding armature having a corresponding section.

What is claimed is:

1. An electromagnetic actuator energizable from a direct-current source, comprising: an elongate plunger of magnetizable material; a hollow tube of magnetizable material for slidably receiving an outer cylindrical surface portion of said plunger and guiding its movement along the longitudinal axis of said tube; an energizing coil coaxially arranged with said tube and said cylindrical surface portion; a pot-like frame of magnetizable material providing a predetermined magnetizable path of flux generated by said coil and lodging said plunger, said tube and said coil, said frame comprising a movable member and a fixed member having respective peripheral tubular portions with respective edge poles facing each other for defining an annular peripheral air-gap, the said magnetic path serially closing through the said peripheral air-gap and through a further elongate air gap defined between said cylindrical surface portion and the said hollow tube for causing actuation of the plunger to a working position under conditions where said coil is energized, the length of the said further elongate air gap parallel to the said axis being substantially larger than the maximum thickness of the said peripheral air gap parallel to the said axis; and means for returning the plunger to a rest position under conditions where said coil is de-energized.

2. The electromagnetic actuator as claimed in claim 1, wherein the respective dimensions of the said peripheral and further air gaps and the cross sectional area of the said cylindrical surface portion are so predetermined that the value of the induction in the plunger evolves substantially in the ratio of 1 to 2 when the said movable member moves between the said rest position and the said working position.

3. The electromagnetic actuator as claimed in claim 1, wherein the coil is shaped as a cylindrical ring and said further air gap extends substantially over the whole height of the said cylindrical ring.

4. An electromagnetic actuator as claimed in claim 1, wherein the said frame further comprises first and second base plates and the said plunger extends the first base plate at right angles thereto, whereas the said tube extends the second base plate substantially at right angles thereto.

5. An electromagnetic actuator as claimed in claim 1, wherein the said frame further comprises a first base plate and the said elongate plunger at a first end thereof extends the said base plate substantially at right angles thereto, whereas a second base plate extends the said plunger and is integrally connected with the said tube.

6. An electromagnetic actuator as claimed in claim 1, wherein the said edge poles of the annular peripheral air gap have surface portions which form an acute angle with the said axis.

* * * * *